United States Patent [19]

Hsiao

[11] Patent Number: 4,934,221

[45] Date of Patent: Jun. 19, 1990

[54] APPARATUS FOR RETAINING A REPLACEABLE TOOL HEAD ON A T-HANDLE-TYPE WRENCH

[76] Inventor: Hsuan S. Hsiao, 15-1, Lane 179, Ming-Tao St., Taichung, Taiwan

[21] Appl. No.: 264,339

[22] Filed: Oct. 31, 1988

[51] Int. Cl.[5] ..... B25B 13/16

[52] U.S. Cl. ..... 81/177.5; 81/177.85; 81/125

[58] Field of Search ..... 81/177.5, 177.3, 177.85, 81/125, 451; 403/361, 342, 286

[56] References Cited

U.S. PATENT DOCUMENTS

| | | | |
|---|---|---|---|
| 198,544 | 12/1877 | Kettlewell | 81/177.85 |
| 2,548,052 | 4/1951 | Phaneuf et al. | 403/361 |
| 3,935,762 | 2/1976 | Tudisco | 81/177.85 |

*Primary Examiner*—Robert P. Olszewski
*Assistant Examiner*—Lawrence Cruz
*Attorney, Agent, or Firm*—Cushman, Darby & Cushman

[57] ABSTRACT

A tool set includes a T-shaped handle, a connector unit having a truncately conical cavity, a screw tap and a screwdriver piece. A socket having a truncately conical end is secured to the handle and has a hexagonal cavity formed in the end surface thereof, and an annular groove formed in the inner surface of the socket. A retaining ring is received within the groove. Both the connector unit and the screwdriver piece have a hexagonal cross-sectioned plug which has circumferentially concaved portions. By matching the truncately conical cavity of the connector unit with the truncately conical end of the socket, and by engaging the hexagonal cavity of the handle with the plug in such a manner that the retaining ring snaps into the concaved portions of the plug, the assembly of the handle, the connector unit and the tap can form a T-handle-type tapping tool, or the assembly of the handle and the screwdriver piece can form a T-handle-type screwdriver.

2 Claims, 5 Drawing Sheets

APPARATUS FOR RETAINING A REPLACEABLE TOOL HEAD ON A T-HANDLE-TYPE WRENCH

BACKGROUND OF THE INVENTION

This invention relates to a T-handle-type tool, more particularly to an apparatus for retaining a replaceable tool head on a T-handle-type wrench.

Referring to FIG. 1, a conventional T-handle-type tapping tool includes a ratchet drive body 1 having an externally threaded end portion 2, an internally threaded sleeve 3 engaged with the end portion 2 of the drive body 1, and a screw tap 4. The sleeve 3 may be tightened so as to hold the tap 4 in the sleeve 3. When the tapping tool is used, a screwdriver, especially of the T-handle-type, is often needed. Accordingly, a T-handle-type wrench is required to rotate either a screw tap or the head of a screwdriver.

SUMMARY OF THE INVENTION

The main object of this invention is therefore to provide an apparatus for retaining a replaceable tool head on a T-handle-type wrench. Another object of this invention is to provide a tool in which the truncately conical end of the T-shaped handle is matched with the truncately conical cavity of the tool head.

According to this invention, a tool includes a T-shaped handle and a tool head detachably connected to the handle. The handle includes a socket having a hexagonal cavity formed in the end surface thereof, an annular groove formed in the inner surface of the socket, and a retaining ring received within the groove. The tool head includes a hexagonal cross-sectioned plug secured thereto. The plug is closely engaged with the socket of the handle and has a plurality of circumferentially concaved portions on which the retaining ring is sleeved.

When the tool is used as a tapping tool, the tool head consists of a tap and a connector unit including means for holding the tap within the connector unit. The plug is provided on the connector unit so as to couple the handle therewith. In one embodiment, the socket has a truncately conical end. Correspondingly, the connector unit has a truncately conical cavity which can accommodate the end of the socket. The plug is fixed in the truncately conical cavity.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
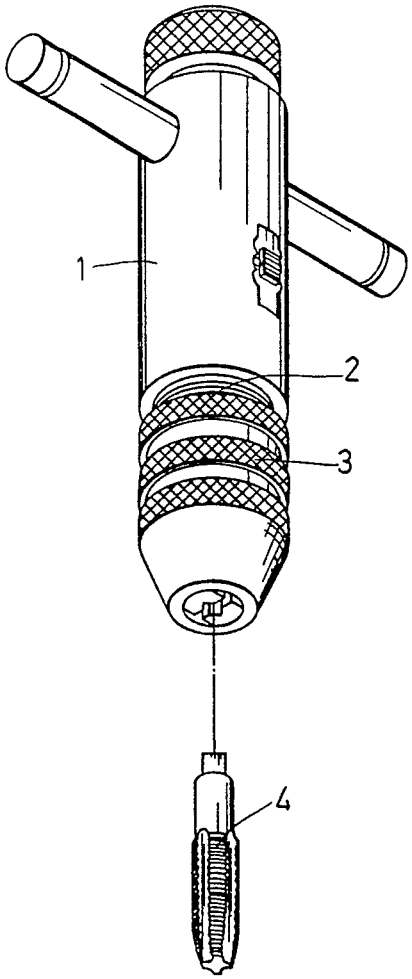
FIG.1 PRIOR ART
FIG. 1 is an exploded view of a conventional tapping tool with a T-shaped handle.
Figure 2:
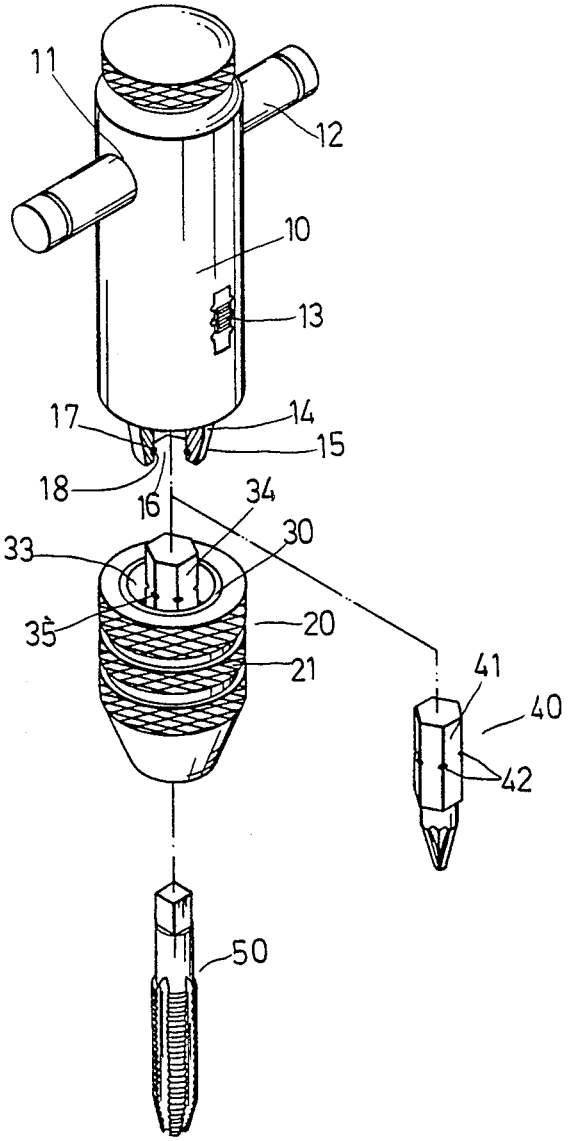
FIG. 2 is a partially exploded view of a tool set according to this invention.

Referring to FIG. 2, a tool set of this invention includes a T-shaped handle 10, a connector unit 20, a screwdriver piece 40, and a screw tap 50.

The handle 10 has a hole 11 through which a rotary lever 12 extends. A rotational direction selection switch 13 is provided on the handle 10 and connected to a conventional ratchet mechanism (not shown) which is disposed in the handle 10. A socket 14 is secured to the lower end of the handle 10. The lower end of the socket 14 has a tapered outer surface 15 and thus forms a truncately conical portion. A hexagonal cavity 16 is formed in the lower end surface of the socket 14. The inner surface of the socket 14 has an annular groove 17 in which a retaining ring 18 is received.

Figure 3:
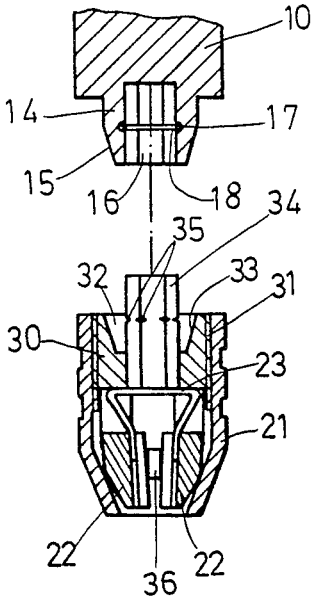
FIG. 3 is a schematic sectional view illustrating the coupling structure between the T-shaped handle and the connector unit of a tapping tool in accordance with this invention.
Figure 4:
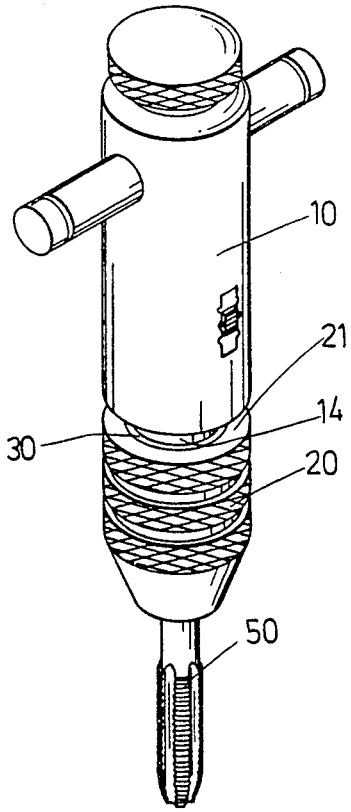
FIG. 4 is an assembled perspective view showing the T-handle-type tapping tool of this invention.
Figure 5:
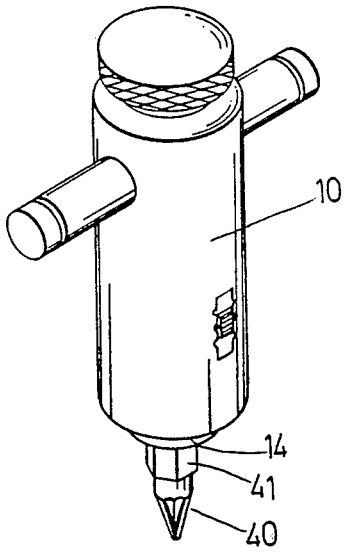
FIG. 5 is a perspective view showing a T-handle-type screwdriver of this invention.

Referring to FIGS. 2 and 3, the connector unit 20 includes a tubular body 21 in which two clamping members 22 are accommodated. The clamping members 22 are biased to move away from each other by a spring member 23. The tubular body 21 has an internally threaded upper end portion 31 so that an externally threaded connector 30 may engage therewith. The upper end surface of the connector 30 has a truncately conical cavity 32 which is defined by a tapered surface 33. A hexagonal cross-sectioned plug 34 is fixed on the connector 30 and extends through the truncately conical cavity 32 thereof so as to closely engage with the hexagonal cavity 16 of the handle 10. When the upper end portion of the plug 34 occupies the hexagonal cavity 16 of the handle 10 and the lower end portion of the socket 14 occupies the truncately conical cavity 32 of the connector 30, the retaining ring 18 is sleeved on the circumferentially concaved portions 35 of the plug 30. The connector unit 20 is thus retained on the handle 10 unless it is forcibly removed from the same. The lower end portion of the connector 30 has two guide grooves 36 whereby the clamping members 22 are positioned in a known manner. The tubular body 21 may be turned upward relative to the connector 30 so as to hold the tap 50 between the clamping members 22.

The screwdriver piece 40 also has a hexagonal cross-sectioned plug 41 having portions 42 which are circumferentially concaved in the same manner as that of the plug 34.

When the connector unit 20 is forcibly separated from the handle 10, the plug 41 of the screwdriver piece 40 may be inserted into the socket 14 of the handle 10 until the retaining ring 18 snaps into the concaved portions 42 of the screwdriver piece 40, thereby forming a T-handle-type screwdriver.

With this invention thus explained, it is apparent that numerous modifications and variations can be made without departing from the scope and spirit of this invention. It is therefore intended that this invention be limited only as indicated in the appended claims.

I claim:

1. A tool, comprising:

a T-shaped handle;

a socket secured to said Tshaped handle, said socket having a truncately conical end and having a hexagonal cavity formed in an end surface corresponding to said end, an annular groove formed in an inner surface of said socket, and a ring received within said groove; and a tool head detachably connected to said handle, said tool head including a truncately conical cavity, and a hexagonal cross-sectioned plug secured to said tool head and extending through said conical cavity, said plug being closely engaged with said socket of said handle and having a plurality of circumferentially concaved portions on which said ring is sleeved, and wherein said end of said socket is fitted in said conical cavity.

2. A tool as claimed in claim 1, wherein a tool piece having a cross-sectioned plug with a plurality of circumferentially concaved portions is fitted in said hexagonal cavity.

* * * * *